United States Patent [19]

Altnau

[11] Patent Number: 4,936,421

[45] Date of Patent: Jun. 26, 1990

[54] CONICAL SPRING BRAKING MECHANISM

[75] Inventor: Ronald L. Altnau, Ripon, Wis.

[73] Assignee: Speed Queen Company, Ripon, Wis.

[21] Appl. No.: 305,133

[22] Filed: Feb. 2, 1989

[51] Int. Cl.[5] ..... B60T 13/04

[52] U.S. Cl. ..... 188/166; 68/23.7; 188/72.1; 192/70.27; 192/89 B

[58] Field of Search ..... 188/166, 167, 170, 171, 188/173, 72.1; 68/23.6, 23.7; 192/70.17, 89 B

[56] References Cited

U.S. PATENT DOCUMENTS

| | | | |
|---|---|---|---|
| 2,770,341 | 11/1956 | Wobrock | 192/89 B X |
| 3,104,746 | 9/1963 | Gadd et al. | 192/89 B X |
| 3,213,991 | 10/1965 | Smirl | 192/89 B X |
| 3,838,755 | 10/1974 | Cochran et al. | 188/166 |
| 4,195,719 | 4/1980 | Martinez | 192/89 B |
| 4,681,200 | 7/1987 | Keck | 192/70.27 |
| 4,734,604 | 3/1988 | Sontheimer et al. | 188/171 X |

*Primary Examiner*—George E. A. Halvosa

*Attorney, Agent, or Firm*—William R. Clark; Richard M. Sharkansky

[57] ABSTRACT

A laundry machine braking mechanism including a pair of spaced plates adapted to be moved axially relative to one another to frictionally compress one or more brake pads positioned therebetween. A conical spring is positioned under the bottom plate, and in normal operation, the outer periphery of the conical spring urges the bottom plate upwardly so as to exert a braking force. The conical spring acts on an integrally formed retainer that has an annular rim contacting the underside of the conical spring, and a plurality of posts that extend up and connect to the top plate thereby fixing the spacing therebetween. The braking mechanism is released by exerting an upward force on the inner periphery of the conical spring thereby deflecting the outer periphery downwardly. An annular flange integrally formed as part of the top plate extends downwardly and acts as an annular fulcrum for the deflection.

9 Claims, 2 Drawing Sheets

CONICAL SPRING BRAKING MECHANISM

BACKGROUND OF THE INVENTION

The present invention generally relates to a braking mechanism for use in laundry machines, and more particularly, to a disc braking mechanism for laundry machines of the type that have an oscillating agitator for washing clothes and a spin tub for centrifugally extracting washing fluid from the clothes.

U.S. Pat. No. 3,838,755 describes a conical spring disc braking mechanism used in the above-described laundry machines. As described therein, the braking mechanism includes a pair of generally flat circular plates adapted to be moved axially relative to one another to frictionally compress one or more brake pads positioned therebetween. One of the plates is fixed to a rotatable spin shaft that extends through an aperture in the brake mechanism. A conical spring is positioned adjacent one of the plates and is pivotable about an annular fulcrum defined by a number of spacers that secure the conical spring to the plates. Deflecting the inner periphery of the conical spring causes its outer periphery to move away from one of the plates thereby releasing the braking force that is applied to the stationary brake pads positioned between the two plates. By permitting the inner periphery of the conical spring to return to its undeflected position, the braking force is reapplied to prevent rotation of the rotatable shaft.

The deflecting force on the inner periphery of the conical spring is applied by a drive pulley that has a hub portion with a helical surface such that the pulley rides upwardly when it is driven in one direction so as to actuate a spin cycle. As a result, the braking force of the plates on the respective sides of the brake pads is released, and the braking mechanism which is attached to the spin shaft is free to rotate. When the drive pulley is driven in the opposite direction so as to actuate the agitate mode of operation, the drive pulley does not ride up on the helical surface, and the conical spring deflecting force is removed. As a result, the plates are forced together by the conical spring such that they apply a braking force to the stationary brake pads thereby preventing the spin tub from rotating during the agitate mode of operation. Simply stated, the braking mechanism brakes the spin tub at the completion of a spin cycle and also prevents the spin shaft from rotating in the agitate mode; however, by driving the pulley in the opposite direction in the spin mode, the conical spring is deflected and the brake is released so that the spin shaft and spin tub are free to rotate.

The performance of the above-described braking mechanism was satisfactory. However, because of the number and character of the parts in the assembly, and the labor required to put them together, the braking mechanism was relatively expensive to fabricate. First, eight individual rivets were used to interconnect the plates and the conical spring, and considerable labor was required to align and fabricate the relatively complex assembly Second, wire rings were required on both sides of the conical spring to provide an annular fulcrum for deflecting the conical spring. Third, the plates were made of relatively thick metal such as, for example, 3/32-inch flat stock steel so as to provide rigidity and also to provide the inner serrated edge with a bearing surface that was sufficient for engaging the splines of the spin shaft. Fourth, an annular groove was provided in one of the plates so as to form a downwardly-extending underside ridge to serve as a bearing surface for the conical spring. This annular groove reduced the surface contact area between that plate and the stationary brake pad thereby leading to excessive wear of the brake pad.

SUMMARY OF THE INVENTION

In accordance with the invention, a disc braking mechanism is provided for use on a rotating shaft, the braking mechanism comprising first and second generally circular plates adapted to be axially moved relative to one another to engage one or more stationary braking pads positioned therebetween, the first plate being rigidly affixed to the shaft, a conical spring having a plurality of openings being positioned adjacent the second plate, an annular base having a plurality of upstanding holding spacers, the annular base being positioned against the conical spring on the opposite side of the second plate with the upstanding holding spacers extending up through the openings in the conical spring and being attached to the first plate such that the outer periphery of the conical spring normally contacts and urges the second plate towards the first plate to apply a braking force to the pads, and means for providing an annular fulcrum over which the conical spring may be deflected, the fulcrum providing means being positioned between the conical spring and the second plate, the deflection occurring by depressing the inner periphery of the spring causing the outer periphery to thereby reduce the force being applied to the second plate and to the brake pads positioned between the first and second plates. It is preferable that the conical spring have a plurality of radially directed slots extending from the inner periphery to the openings. Also, it is preferable that the annular base have an annular rim that engages the conical spring on the underside wherein the conical spring acts on the rim to urge the second plate toward the first plate to apply the braking force to the pads Further, it is preferable that the fulcrum providing means comprise an annular flange extending downwardly from the first plate. Also, the second plate may have a plurality of dimples arranged in a circular pattern and extending downwards towards the conical spring wherein the conical spring engages the dimples. Further, it is preferable that the holding spacers be integrally formed with the base such as by die forming. Also, it is preferable that the first and second plates be annular, and that the inner and outer edges of both the first and second plates have rims so as to provide increased rigidity.

With such arrangement, the braking mechanism is made with far fewer parts than a similar prior art braking mechanism. Whereas the prior art mechanism used eight individual holding spacers or rivets along with a corresponding number of washers and two wire rings to form the annular fulcrum, the present invention uses a single die formed part. More specifically, the die formed part includes an annular base, and the individual rivets are replaced by eight upstanding posts formed on the base. Also, the base has a rim that replaces the wire ring on one side of the conical spring, and the annular fulcrum on the opposite side is provided by an annular flange extending down from the top plate rather than positioning another wire ring against the shoulders of rivets Not only is the cost of the parts greatly reduced, but the present invention requires less labor to assemble because there are fewer parts to manipulate and they are self-aligned. That is, for example, the posts extending up from the base are parallel and aligned so as to easily fit through the openings in the conical spring and the apertures of the top plate where they can be simultaneously flattened using a rivet machine to hold the entire brake mechanism together.

Further, with such arrangement, the plates can be made from relatively thin metal because each is annular and has a rim on the inner and outer edges to increase rigidity. Also, by using dimples at various locations around the bottom plate so as to provide a contact surface for the conical spring, the braking surface area is not significantly reduced as it was with the prior art braking mechanism that had an annular groove for contacting the conical spring.

BRIEF DESCRIPTION OF THE DRAWINGS

The foregoing objects and advantages will be more fully understood by reading the Description of the Preferred Embodiment with reference to the drawings wherein.

DESCRIPTION OF THE PREFERRED EMBODIMENT

Figure 1:
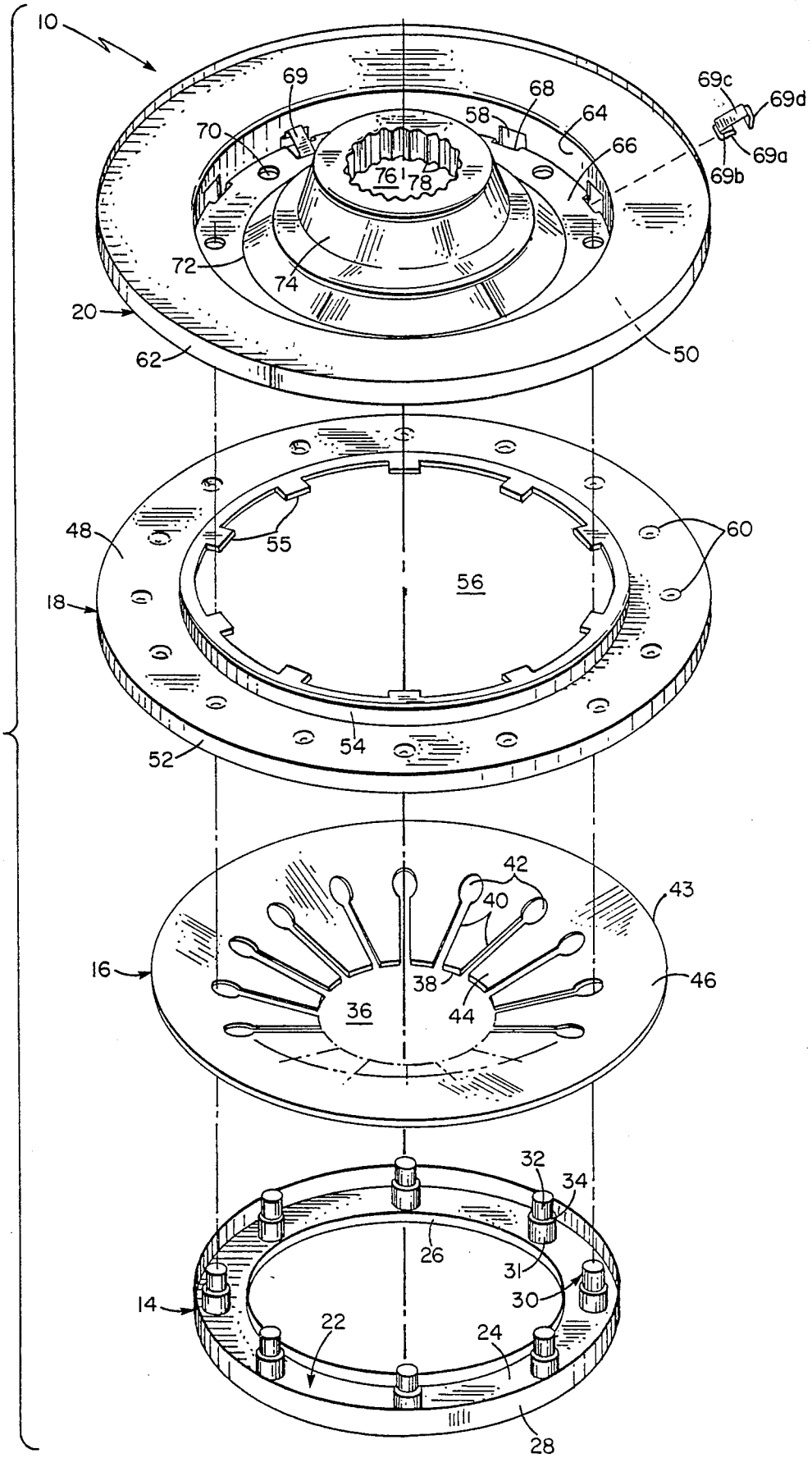
FIG. 1 is an exploded view of the braking mechanism.
Figure 2:
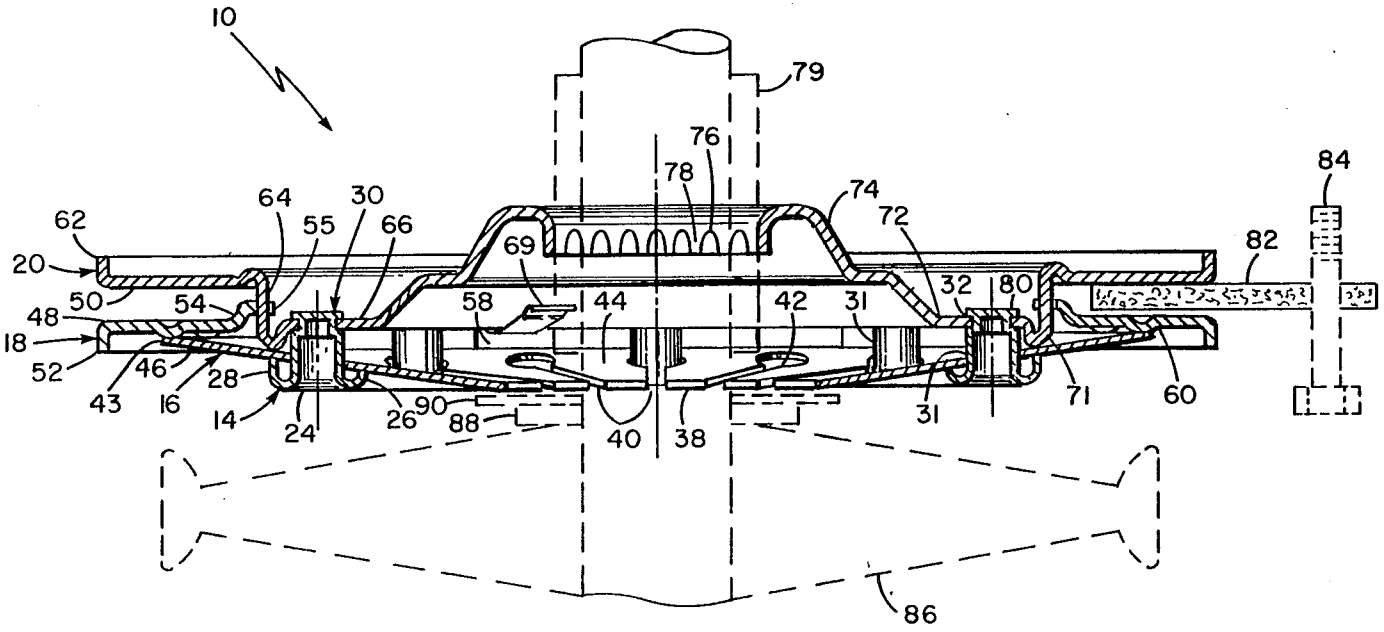
FIG. 2 is a sectioned view of the braking mechanism assembled.

FIGS. 1 and 2 respectively show braking mechanism 10 in an exploded view and a sectioned assembly view In accordance with the invention, braking mechanism 10 is an interchangeable replacement for the brake mechanism used in the laundry machine shown and described in U.S. Pat. No. 3,838,755, which is hereby incorporated by reference. Accordingly, most of the other parts and components of the laundry machine will not be shown or described in detail here. As shown best in FIG. 1, braking mechanism 10 generally includes an annular retainer 14, a conical spring 16, a bottom or axially movable plate 18, and top or axially fixed plate 20.

Annular retainer 14 is a unitary die-formed metal part that includes an annular trough 22 with a relatively flat annular base 24 and inner and outer rims 26 and 28, respectively. For reasons to be described later herein, the outer rim 28 of trough 22 preferably extends above or is taller than the inner rim 26. Extending upwardly from base 24 are a plurality such as, for example, eight posts 30 or upstanding holding spacers each of which has a lower enlarged portion 31 and a top neck portion 32 defining a shoulder 34 therebetween.

Conical spring 16 is similar or identical to the conical spring described in U.S. Pat. No. 3,838,755. That is, conical spring 16 is a relatively small angle, flexible metal cone that is truncated so as to form a central aperture 36 having an inner periphery 38. A number of radially extending slots 40 extend from the inner periphery 38 to respective enlarged openings 42 that are arranged in a circle at a midportion between the inner periphery 38 and the outer periphery 43. The radial slots 40 permit the spring to be more easily deflected, since the elongated strips 44 or fingers between adjacent slots 40 are adapted to function as levers for deflecting the solid outer portion 46 of conical spring 16. It should be understood that a substantially greater force would be required to depress the inner periphery 38 of the conical spring 16 if the slots 40 were not present. Additionally, a conical spring capable of generating a given amount of force may be used, the strips 44 permitting the conical spring 16 to be actuated or deflected with a lesser amount of force. Thus, a conical spring 16 having a greater strength may be used with a lesser available actuating force and may accordingly be more compatible with the characteristics of the actuating mechanism existing in a particular machine application.

Bottom plate 18, as will be described later herein, is movable in the axial direction with respect to top plate 20 which is axially fixed. Bottom plate 18 is a unitary metal part preferably die-form stamped from cold rolled steel of relatively thin thickness such as, for example, 1/16-inch. Bottom plate 18 has an annular disk surface area 48 that spacedly opposes a corresponding annular disk surface area 50 on the underside of top plate 20. Rims 52 and 54 respectively extend downward and upward from the outside and inside of annular disk surface area 48 thereby giving increased rigidity to bottom plate 18. Extending inwardly into large central aperture 56 from the top of rim 54 are a plurality of teeth or locking tabs 55 that are spaced to align with respective windows 58 of top plate 20. A plurality of dimples 60 extend downwardly from the underside of annular disk surface area 48.

Top plate 20, like bottom plate 18, is a unitary metal part preferably die-form stamped from cold rolled steel of relatively thin thickness, such as, for example, 1/16-inch. As stated earlier, top plate 20 has a downward-facing annular disk surface area 50 that is spaced parallel to the corresponding disk surface area 48 of bottom plate 18. Rims 62 and 64 respectively extend upwardly and downwardly from the outside and inside, respectively, of annular disk surface area 50. These rims 62 and 64 provide the relatively thin metal of top plate 20 with additional rigidity. Rim 64 has a plurality of windows 58 that are cut so as to align with respective locking tabs 55 of bottom plate 18. Top plate 20 also has an annular floor 66 that has small notches 68 adjacent to windows 58. Spacer clips 69, the function of which will be described subsequently, are inserted through windows 58 and engage to portions of floor 66 adjacent notches 68. More specifically, each clip 69 has parallel clip members **69*a* and *b* that clip onto floor 66, and a resilient member 69*c* that extends to a head 69*d* that extends outwardly past notch 68 into window 58. As can be seen best in FIG. 2, rim 64 or wall extends down below floor 66 and then bends or folds back up so as to form annular flange 71**.

A plurality of circular apertures 70 are arranged around floor 66 so as to align with respective posts 30 of annular retainer 14. From the inner periphery 72 of annular floor 66, top plate 20 rises upwardly to form a mound 74, and then bends downwardly to form a serrated aperture 76 in the center. Similar to the prior art brake mechanism, serrated aperture 76 has a plurality of circumferential teeth 78 that are adapted to mate with the splines (not shown) of the spin shaft 79 (FIG. 2) thereby affixing top plate 20 to the spin shaft 79. Because top plate 20 is bent downwardly in the region of serrated aperture 76, the bearing surface against the splines of the spin shaft 79 is relatively large even though top plate 20 is of relatively thin metal.

To assemble braking mechanism 10, annular retainer 14 is positioned as shown in FIG. 1 with the posts 30 extending upwardly. Next, conical spring 16 is seated down on annular retainer 14 with posts 30 extending up through corresponding enlarged openings 42 of conical spring 16 Typically, there are more slots 40 than there are posts 30, such as, or example, sixteen as compared to eight However, slots 40 and corresponding enlarged openings 42 are arranged in equal increments of spacing, as are posts 30, such that it is easy to align openings 42 over corresponding posts 30 and then lower conical spring 16. The size of enlarged openings are such that they are larger than both the neck portion 32 and lower enlarged portion 31 of posts 30 Accordingly, conical spring 16 seats against rims 26 and 28 of trough 22. As described earlier herein, outer rim 28 extends above inner rim 26 so that conical spring 16 supportedly engages outer rim 28 even though conical spring 16 has an downward slope towards the center in the undeflected state as shown in FIG. 2.

Next, bottom plate 18 is seated down on top of conical spring 16. More specifically, dimples 60 on the underside of bottom plate 18 come to rest and are supported by a portion of conical spring 16 immediately proximate the outer periphery 43. Posts 30 extend up through large central aperture 56 between corresponding locking tabs 55. Top pate 20 is then positioned down onto posts 30 from the top. More Specifically, the circular apertures 70 of floor 66 are larger than the neck portions 34 of posts 30, but are smaller than the lower enlarged portions 31 of posts 30. As shown in FIG. 2, annular flange 71 extends downwardly below floor 66 and contacts conical spring 16 immediately above outer rim 28 The spacing between opposing locking tabs 55 is less than the outer diameter of rim 64 such that the locking tabs 55 must be keyed to corresponding windows 58 and notches 68 in order for top plate 20 to be lowered into position Finally, a rivet machine comes down to mushroom over or flatten the tops of neck portions 34 so as to form rivet heads 80 that secure braking mechanism 10 into an assembly. In such arrangement, the annular retainer 14, conical spring 16, bottom plate 18 and top plate 20 are engaged so that they are not rotatable with respect to each other. The posts 30 extend through enlarged openings 42 and circular apertures 70 so as to prevent respective rotation of these parts, and the locking tabs 55 insert into windows 58 of top plate 20 so as to prevent rotation of these two parts relative to each other. Further, the spacing between annular retainer 14 and top plate 20 is fixed because top plate 20 is securely engaged between shoulders 34 and heads 80 of posts 30. However, depending on the force exerted on bottom plate 18 by conical spring 16, bottom plate 18 can move axially with respect to top plate 20 as locking tabs 55 move axially within windows 58. The spacer clips 69 exert a downward force on the bottom plate 18 such that when the much larger upward force of conical spring 16 is released when the spring 18 is deflected, the bottom plate 18 is held apart from top plate 20 so that it doesn't rattle or chatter as the brake mechanism 10 rapidly rotates in the spin mode.

Braking mechanism 10 operates in the same general manner as the prior art braking mechanism described in detail in U.S. Pat. No. 3,838,755. That is, braking mechanism 10 is adapted to be attached to the spin shaft 79, the lower end of which is provided with a number of axially-aligned splines (not shown) that are engaged by the teeth 78 of serrated aperture 76 of top plate 20 which is therefore held in a fixed or stationary axial position. As heretofore stated, bottom plate 18 is capable of being moved axially relative to top plate 20. It is this relative movement between the two plates 18 and 20 and more particularly the relative axial movement of respective disc surface areas 48 and 50 that effectively applies or releases a braking force by compressing or releasing on brake pads 82 that are positioned therebetween. More specifically, with reference to FIG. 2, the brake pads 82 are secured to the frame structure (not shown) of the laundry machine by suitable means such as threaded bolts 84. Accordingly, brake pads 82 are not free to rotate about the axis of spin shaft 79. Since the brake pads 82 extend between plates 18 and 20 and inwardly beyond the outer peripheries of disk surface areas 48 and 50, it should be understood that when the plates 18 and 20 are forceably urged toward one another to press against brake pads 82, braking forces will be generated which will inhibit movement of the top plate 20 and the entire braking mechanism 10, and therefore the spin shaft 79 to which it is attached It should also be apparent that when bottom plate 18 is moved away from top plate 20 such that they no longer compress on stationary brake pads 82 therebetween, the braking force will be released and both plates 18 and 20 will be free to rotate relative to fixed brake pads 82; this frees the spin shaft 79 to rotate and occurs during the spin mode of operation during a washing cycle.

To generate the force for pressing axially movable bottom plate 18 to move toward axially fixed top plate 20 to compress the respective disc surface areas 48 and 50 on brake pads 82 and produce the braking force, braking mechanism 10 utilizes conical spring 16. More specifically, with reference to FIG. 2, conical spring 16 is shown in the undeflected state wherein a braking force is exerted to prevent the spin shaft 79 from rotating. This is the braking mode used to prevent the spin tub from rotating during the agitation mode of operation, and to brake or stop the spin tub at the completion of the spin cycle. Posts 30 or holding spacers that are part of annular retainer 14 and are attached to top plate 20 by deforming their tops guarantee a fixed distance or space between top plate 20 and trough 22 of annular retainer 14. The outer rim 28 of annular retainer 14 supports and forms an annular fulcrum for conical spring 16 in the undeflected state as shown in FIG. 2. The shapes and dimensions of the respective parts are selected so that conical spring 16 applies a force urging bottom plate 18 toward top plate 20 to thereby generate a braking force against brake pads 82 under normal conditions. Thus, solid outer portion 46 immediately adjacent outer periphery 43 of conical spring 16 pushes against the dimples 60 of bottom plate 18 by virtue of the force of the conical spring 16 acting on the outer rim 28 of annular retainer 14. Whereas in the prior art braking mechanism the force was on individual spacers such that washers and a wire ring were required to more equally distribute the force being applied, here outer rim 28 provides a complete and continuous annular fulcrum for conical spring 16, and equal distribution of the force is provided without resort to additional parts. Further, whereas in the prior art braking mechanism the conical spring 16 engaged the underside of a groove in the disc surface area 48, here the conical spring 16 engages dimples 60 so that there is more braking surface area on bottom plate 18 thereby increasing the wear characteristics of brake pads 82. Dimples 60 provide a raised surface on the underside of bottom plate 18 so that as conical spring 16 moves back and forth from deflected and undeflected states as will be described, the force is applied without the outer periphery 43 of conical spring 16 gouging into the under surface of bottom plate 18.

To release braking mechanism 10 which would be necessary for operating in the spin mode of operation during a washing cycle, the pulley 86 is reversed in drive directions such that it rides up and pushes the needle bearing 88 and flat washer 90 to deflect the inner periphery 38 of conical spring 16 upwardly. More specifically, when the inner periphery 38 of conical spring 16 is pushed upwardly toward fixed top plate 20, annular flange 71 acts as an annular fulcrum at the mid-portion on the top side of conical spring 16 and the outer periphery 43 of conical spring is caused to move downwardly thus removing the upwardly urging force on bottom movable plate 18. Accordingly, when conical spring 16 is forced by pulley 86 to the deflected state wherein the inner periphery 38 is up and the outer periphery 43 is down, disc surface area 48 moves down away from disc surface area 50 and the braking force is removed or eliminated. Therefore, the entire braking mechanism 10 which is attached to spin shaft 79 is free to spin or rotate axially. Whereas in the prior art braking mechanism a wire ring was required to more equally distribute the force being applied during the deflecting process, here annular flange 71 provides a complete and continuous annular fulcrum for conical spring 16, and equal distribution of force is provided without resort to additional parts.

In summary, when there is no upward force on the fingers 44 or inner periphery 38 of conical spring 16, an upward force is exerted on the dimples 60 of bottom movable plate 18 by conical spring 16 acting on the lower annular fulcrum provided by outer rim 28 of annular retainer 14. Accordingly, the spacing between respective disc surface areas 48 and 50 of bottom and top plates 18 and 20 is reduced thereby clamping down on one or more brake pads 82 thereby preventing the braking mechanism 10 from rotating about the axis of shaft 79. The top plate 20 is affixed to the spin shaft 79 and accordingly, this configuration is used to prevent the spin tub from rotating in the agitate mode, and to brake it at the completion of the spin cycle. When an upward force is exerted on the fingers 44 or inner periphery 38 of the conical spring 16 by pulley 86 riding upwardly, the conical spring 16 deflects about the annular fulcrum defined by annular flange 71 of the top plate 20 such that the outer perhiphery 43 of the conical spring 16 moves downwardly thereby releasing the upward braking force on bottom plate 18. As a result, the braking force on brake pad 82 is released and the braking mechanism 10 is free to rotate with the spin shaft 79 in the spin mode of operation.

This concludes the Description of the Preferred Embodiment. However, those skilled in the art will understand that there are a variety of modifications possible without departing from the spirit and scope of the invention. Accordingly, it is intended that the scope of the invention be limited only by the appended claims.

What is claimed is:

1. A disc braking mechanism for use on a rotating shaft, comprising:

first and second generally circular plates adapted to be axially moved relative to one another to engage one or more stationary braking pads positioned therebetween, said first plate being rigidly affixed to said shaft;

a conical spring having a central aperture defining an inner periphery having a plurality of openings, said conical spring having a first side facing said second plate and a second side facing away from said plate, said first side being positioned adjacent said second plate;

a unitary die-formed metal retainer comprising an annular base having integrally formed therewith a plurality of upstanding holding spacers, said annular base being positioned against said second side of said conical spring, said upstanding holding spacers extending up through said openings in said conical spring and being attached to said first plate such that the outer periphery of said conical spring normally contacts and urges said second plate towards said first plate to apply a braking force to said pads; and means comprising an annular flange extending downwardly from said first plate for providing an annular fulcrum over which said conical spring may be deflected, said fulcrum providing means being positioned between said conical spring and said second plate, said deflection occurring by depressing said inner periphery of said spring causing said outer periphery to thereby reduce the force being applied to said second plate and to the brake pads positioned between said first and second plates.

2. The disc brake mechanism recited in claim 1 wherein said conical spring has a plurality of radially directed slots extending from said inner periphery to said openings.

3. The braking mechanism recited in claim 1 wherein said annular base has an annular rim engaging said conical spring, said conical spring acting on said rim to urge said second plate toward said first plate to apply said braking force to said pads.

4. The braking mechanism recited in claim 1 wherein said second plate has a plurality of dimples arranged in a circular pattern and extending towards said conical spring, said dimples engaging said conical spring.

5. The braking mechanism recited in claim 1 wherein said first and second plates are annular, each having a rim on both the inner and outer edges to provide increased rigidity.

6. A disc braking mechanism for use in a laundry machine having a vertical spin tub driven by a rotatable shaft, the braking mechanism comprising:

a first plate having an annular disc surface area with an inner rim extending downwardly and being bent back upwardly providing an annular flange, said first plate further comprising an annular floor extending inwardly from said annular flange and having a plurality of apertures, said first plate further having a raised central portion connected to said floor and extending downwardly into a serrated central aperture connected to said shaft;

a second plate positioned below said first plate and having an annular disc surface area parallelly spaced from said annular disc surface area of said first plate, said second plate being adapted to be axially movable relative to said first plate;

at least one brake pad positioned between said annular disc surface areas of said first and second plates, said brake pad being stationarily affixed in said laundry machine, said plates being rotatable relative to said pad when said plates are separated from one another a distance greater than the thickness of the pad;

a conical spring positioned below said second plate, said conical spring having an outer periphery adapted to contact said second plate and urge said second plate toward said pad and said first plate to normally apply a compressive force on said pad to inhibit rotational movement of said shaft; and means for retaining said conical spring and said first and second plates together in an assembly, said retaining means comprising a unitary die-formed metal part comprising an annular trough having a rim contacting the underside of said conical spring, said retainer means having a plurality of integrally formed posts extending upwardly through holes in said conical spring and inserted through respective ones of said apertures in said first plate, said posts having flattened heads to affix said retaining means to said first plate wherein said rim of said retaining means pushes up against and forces said conical spring to exert a force on said second plate thereby applying a braking force to said brake pad, said conical spring being deflectable by an upward force on its inner periphery wherein said annular flange of said first plate acts as an annular fulcrum about which said conical spring is deflected, said deflection causing the outer periphery of said conical spring to move downwardly and release the braking force on said second plate so that said shaft and said spin tub are free to rotate in a spin mode of operation.

7. The braking mechanism recited in claim 6 wherein said annular disc surface area of said second plate has a plurality of downwardly extending dimples contacting said conical spring.

8. The braking mechanism recited in claim 6 wherein said rim of said first plate has a plurality of windows, and said second plate has a large central aperture with a plurality of inwardly extending locking tabs, said tabs being inserted in said windows of said first plate so that said first and second plates are not free to rotate relative to each other.

9. The braking mechanism recited in claim 8 further comprising a plurality of resilient clips coupled to said first plate adjacent said windows for exerting a downward force on said second plate during said spin operation to prevent rattling.

* * * * *